US005980390A

United States Patent [19]

Ferrante

[11] Patent Number: 5,980,390

[45] Date of Patent: Nov. 9, 1999

[54] DIE FOR SELF DRILLING SCREWS

[76] Inventor: Frank Ferrante, 3438 Old Lebanon Rd., Campbellsville, Ky. 42719

[21] Appl. No.: 08/953,588

[22] Filed: Oct. 17, 1997

[51] Int. Cl.[6] ..... B21H 3/02

[52] U.S. Cl. ..... 470/65; 470/86; 470/183

[58] Field of Search ..... 470/8, 9, 11, 12, 470/57, 58, 65, 86, 183, 191; 72/352

[56] References Cited

U.S. PATENT DOCUMENTS

| | | | |
|---|---|---|---|
| 3,207,024 | 9/1965 | Sommer | 470/9 |
| 3,747,143 | 7/1973 | Eager | 470/9 |
| 4,114,507 | 9/1978 | Fischer et al. | 470/9 |
| 4,136,597 | 1/1979 | Takemura et al. | 470/9 |
| 4,147,088 | 4/1979 | Whittaker, Jr. | 470/9 |
| 4,677,703 | 7/1987 | Yamasaki | 470/65 |

FOREIGN PATENT DOCUMENTS

| | | | |
|---|---|---|---|
| 1-75138 | 3/1989 | Japan | 470/65 |
| 6-7881 | 1/1994 | Japan | 470/9 |

*Primary Examiner*—Joseph J. Hail, III
*Assistant Examiner*—Ed Tolan
*Attorney, Agent, or Firm*—Bauer & Schaffer, LLP

[57] ABSTRACT

Improved die for use in the manufacture of self drilling screws comprising a forwardly disposed work face provided with cavity for forming the point and flute section of the screw, a recess proximate to the cavity for receiving a portion of the flash material produced during forging and a planar bumper area terminating in a top edge proximate to the cavity.

5 Claims, 3 Drawing Sheets

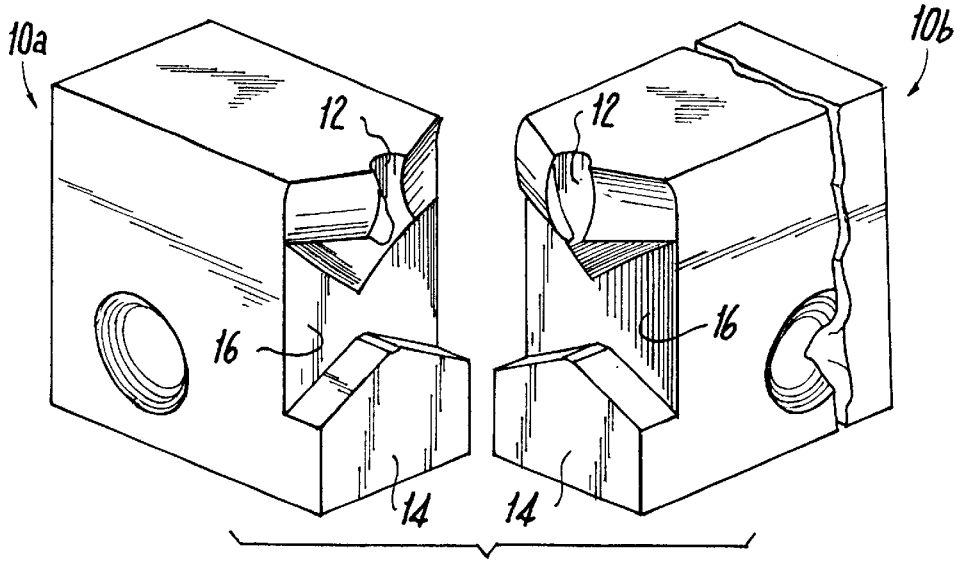
FIG. 1
Prior Art
FIG. 2a
Prior Art
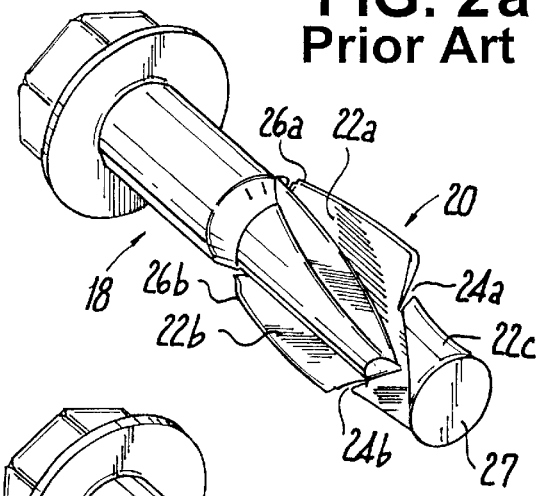
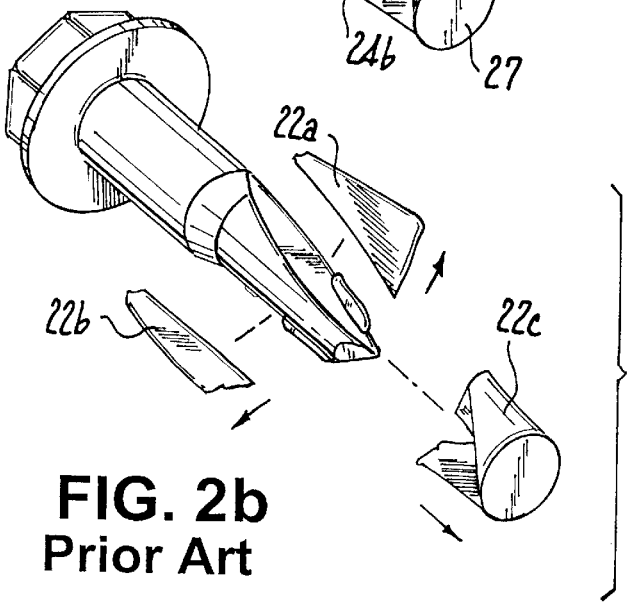
FIG. 2b
Prior Art
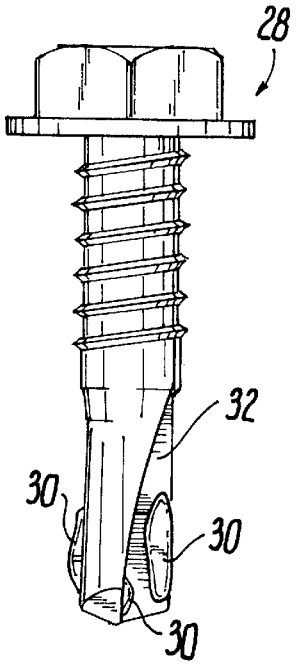
FIG. 2c
Prior Art

DIE FOR SELF DRILLING SCREWS

BACKGROUND OF THE INVENTION

The present invention relates to an improved die for use in the manufacture of self-drilling screws, and, in particular, to a die that produces a forged blank having an endchip that may be removed in one piece during the thread-rolling process.

Screws and fasteners having the capability for drilling a pilot hole and forming threads in the workpiece without the need to predrill are well known. Such screws and the dies by which they are made are illustrated in U.S. Pat. Nos. 3,395,603; 3,517,542; and 4,836,730.

The procedure used to manufacture self-drilling screws according to these patents is to impression forge a blank using a pair of matching dies to form the point and flute section of the screw. The forged blank is then thread-rolled to form the threaded section. Dies used in the forging process generally consist of a rectangular body having a work face with a conical recess therein. The work face of each die is orientated so as to align in face to face abutment with the work face of the matching die. In this way, the conical recess of each die act in conjunction to define a space for a screw blank to be inserted and forged therein. Jigs are often used in the forging process to secure the dies in place, as disclosed in my prior patent U.S. Pat. No. 5,014,540.

Although many of the fasteners disclosed in the prior art have had commercial success, there have been areas recognized that are subject to improvement. For instance, it has been found that during the forging process described, some of the blank material flows outward of the forging cavity forming an endchip. The endchip consists of a flash of material that is left around and just below the head of the self-drilling screw.

In conventional die designs the endchip created consists of a series of brittle fragments that during the thread-rolling process fracture in multiple pieces leaving a portion of the endchip in the flute section of the screw. This results in a screw having diminished drilling performance. As a result, the screw may be difficult to install or can fail completely during installation.

The endchips created by traditional dies can also create problems in post forming processes. If the screw is heat treated the endchips can fall off and clog the furnace; or if the screw is plated the endchip can dislodge during the plating process and attach to recesses in the head portion of the screw causing problems in the installation of the screw.

It is, therefore, the object of the present invention to provide an improved die design for use in the manufacture of self tapping screws. Specifically, it is the object of the present invention to provide a die design that produces a workpiece having an endchip that can be rolled off in one piece during the thread-rolling process, thereby producing a screw having improved surface finish and drilling performance. An additional object is to provide a die that will reduce costs and downtime associated with post-forming processes.

The foregoing objects and numerous advantages of the present invention will be apparent from the following disclosure.

SUMMARY OF THE INVENTION

According to the present invention an improved die for use in the manufacture of self-drilling screws is provided comprising a generally rectangular solid metal block having a top side, front side, forwardly disposed work face and planar bumper area. The work face is provided with a cavity therein for receiving a screw blank and forming the point and flute section of the screw in the same. The work face is also provided with an shallow recess adjacent to the cavity for receiving flash material produced during the forging process. The bumper area in the present invention is provided with an elongated vertical face.

The elongated bumper and recess act in conjunction to create an endchip that is both stronger and more uniform than those created by conventional dies. As a result, the endchip can be removed in a single piece during the thread rolling process, producing a screw that has improved surface finish as well as enhanced performance capabilities.

Full details of the present invention are set forth in the following detailed description and the illustrations in the accompanying drawings.

BRIEF DESCRIPTION OF THE DRAWINGS

In the drawings:

FIG. 1 is a perspective view showing a matching pair of conventional dies found in the prior art;

FIG. 2*a* shows a blank forged by the conventional die shown in FIG. 1;

FIG. 2*b* shows the endchip after the blank in FIG. 2*a* has been thread-rolled;

FIG. 2*c* shows the finished screw produced from the blank in FIG. 2*a;*

FIG. 4*c* shows the finished screw produced from the blank in FIG. 4*a.

DETAILED DESCRIPTION OF THE INVENTION

Figure 3:
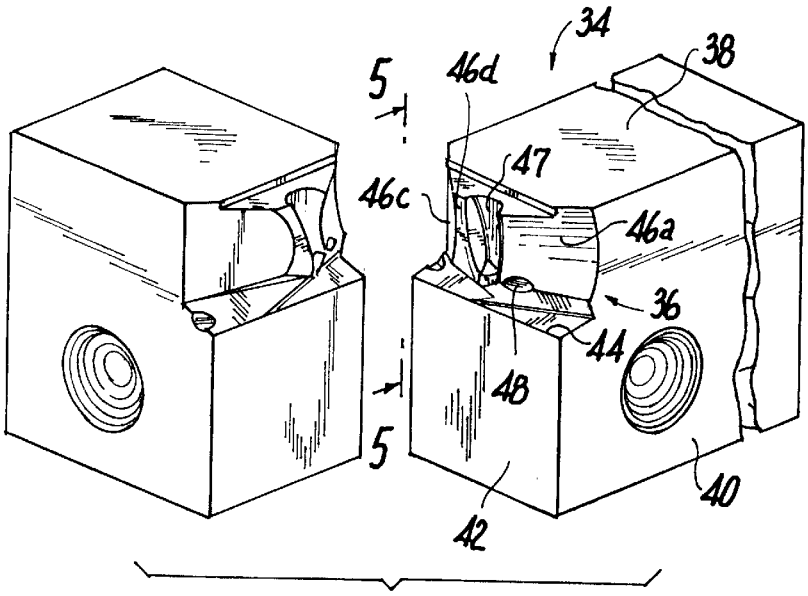
FIG. 3 shows the die pair according to the present invention.

The procedure commonly used to manufacture self-drilling screws is to impression forge a metal blank using a pair of matching dies. The matching dies are provided with a cavity to form the point and flute section of the screw. During the forging process a portion of the blank material flows outward of the cavity region and forms a fragmented endchip. The resultant workpiece is then thread-rolled to form the threaded portion of the screw. During the rolling process the endchip is removed, however the endchips produced by conventional die designs are brittle and fracture in multiple pieces during the thread rolling. As a result, pieces of the endchip are left in flute section of the screw, producing a screw with diminished drilling capabilities.

A conventional die pair is shown in FIG. 1. As seen each die 10*a* and 10*b* has a cavity 12 for forming the point and flute section in the pilot end of the screw. Each die has a triangular bumper region 14 along which the dies are aligned in face to face abutment during the forging process. A clearance recess 16 is provided in the die so as to allow the necessary clearance for the reception of the metal blank.

A forged screw blank 18 produced from the conventional die shown in FIG. 1 is depicted in FIG. 2*a*. Forged blank 18 has an endchip 20 with three distinct portions 22*a,* 22*b* and 22*c*. The endchip portions are likely to be separated by fractures depicted by numerals 24*a* and 24*b*, increasing the likelihood of fragmentation during the thread rolling process.

Peripheral edges 26*a* and 26*b* of the endchip are characterized by heavy creases further reducing the overall strength of the endchip. In addition, the bottom surface 27 of the endchip is circular in cross section indicating that this portion of the endchip was unaffected during the forging process. This inconsistency in cross-section further fragments the endchip resulting in an endchip that can not be removed in one piece during the thread-rolling process.

As a result, as seen in FIG. 2*b*, the endchip due to its diminished strength fractures during the thread-rolling process into portions 22*a*, 22*b* and 22*c*. Screw 28 that is produced, as seen in FIG. 2*c*, has residual pieces 30 of the endchip in the flute section 32 of the screw. These residual pieces of the endchip diminish the drilling capabilities of the flutes. Furthermore, if the screw is heat treated or plated these residual portions may dislodge during these processes creating additional problems.

Figure 5:
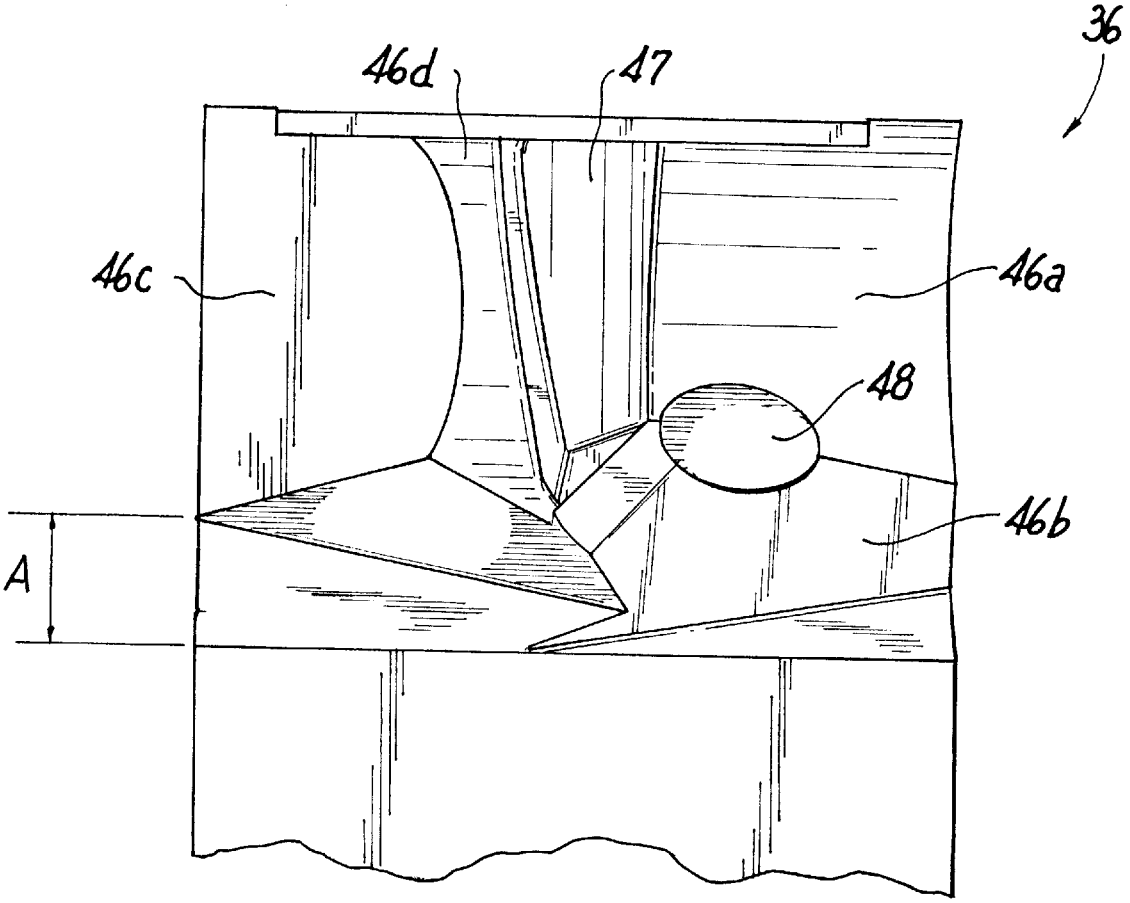
* and FIG. 5 shows a enlarged view of the die face taken in the direction of the plane 5—5 in FIG. 3.

The inventive die generally depicted by the numeral 34 is seen in FIGS. 3 and 5 as being formed of a solid metal block having an upper portion with a work face generally depicted by the numeral 36, a top side 38, sides 40 and a lower front portion forming a bumper 42. Bumper 42 has a elongated vertical face terminating in a top edge 44. The work face 36 is formed of surfaces 46*a*, 46*b*, 46*c* and 46*d*. A generally semi-conical shaped point and flute forming cavity 47 is provided, so that when the die is placed in face to face abutment with a cooperating die so as to form a point and flute in a screw blank during a convention forging process. The surfaces 46*a*, 46*b*, 46*c* and 46*d* are angled away from the forming cavity 47. Preferrably surface 46*a* is convex and extends from the cavity 47 to the associated side 40, while the remaining surfaces are generally flat.

A recess 48 is provided at the intersection of surfaces 46*a* and 46*b*. Recess 48 is offset from forming cavity 47, by a small amout while being proximate thereto so as to receive some of the flash material as it flows outward of cavity 47 during the forging process. Recess 48 by receiving some of the flash material creates a more consistent and less abrupt edge to the endchip that is created during the forging process. This strengthens the corners of the endchip, increasing its overall strength and its unity.

Recess 48 comprises an inner arcuate surface with an approximate length of 3/16" and width of 1/8". These measurements are applicable for a die producing a screw with a diameter of 3/16" and may be modified as required for fasteners of various sizes.

Recess 48 may be circular, oval, uniform, nonuniform or elliptical as shown in the drawings. It is only critical that the recess allow for the reception of the flash material and be proximate to cavity 47.

Bumper 42 has a vertical face that is longer as compared to those found in conventional dies, so that it reaches closer to the lower apex of the cavity 47. This distance, shown by the double arrow A, is thus rendered smaller than the conventional distance (compare with FIG. 1). Distance A should be slightly larger than 3/16" for a die producing a screw with diameter of 3/16".

Die 36 is formed of a appropriate die steel designed for high strength, impact toughness and wear resistance. A suitable such material is a sintered metal carbide alloy, such as tungsten carbide.

The cooperative function of the longer bumper 42 and recess 48 to create a metal flow which produces an endchip that is flatter and more uniform, significantly stronger than those produced by conventional dies. Due to the endchip's uniformity and strength it can be removed in one piece during the thread rolling process, as seen in the sequence of FIG. 4.

Figure 4A:
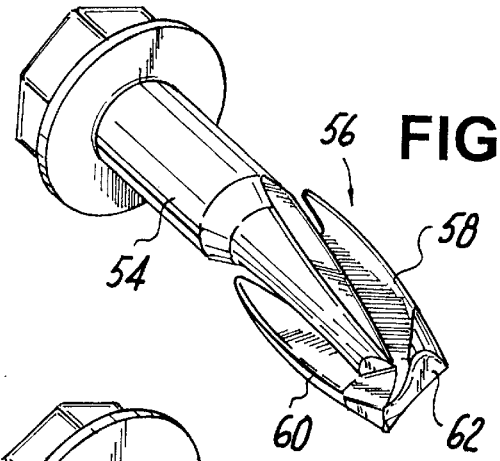
FIG. 4*a* shows a blank forged by the die according to the present invention.
Figure 4B:
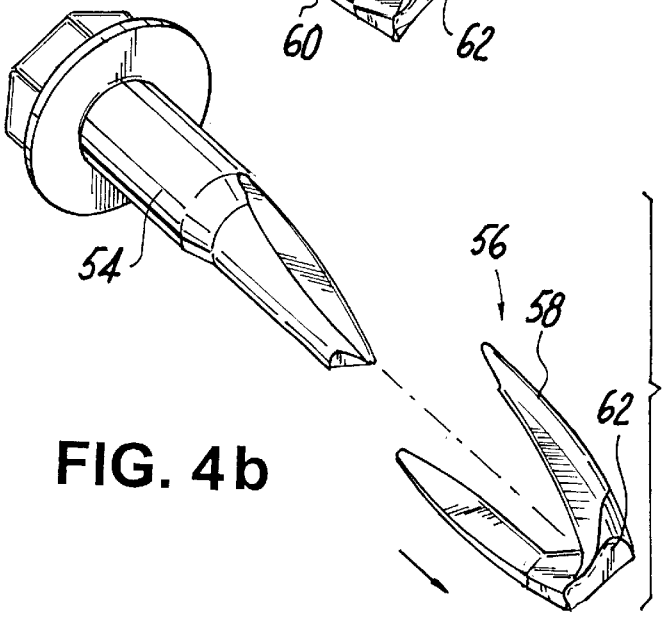
FIG. 4*b* shows the endchip after the blank in FIG. 4*a* has been thread-rolled.
Figure 4C:
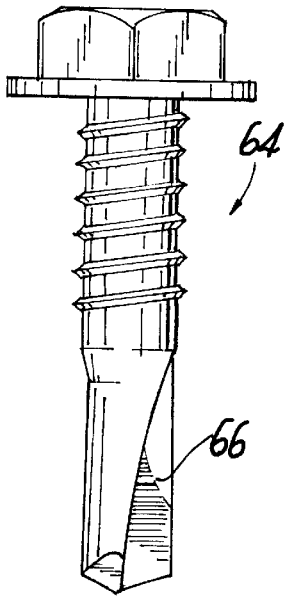

Referring to sequece of FIG. 4*a* to FIG. 4*c*, screw blank 54 forged using the die described in accord with FIGS. 3 and 5 is characterized by a uniform endchip 56 that lacks the portions and fragments found in the prior art. Also, the flash 58 has side edges 60 which lack the creases and cracks thereby avoiding the disadvantages found in the conventional forged screw blank. Further, the entire flash 58 remains unitary as well as uniformly planar which allows its removal in one piece. In addition, the bottom surface 62 of the endchip is flattened during the forging process creating an endchip that is uniform in cross section.

The endchip 56 can be thus removed in one piece during thread rolling, or other finishing process, to form a self-drilling screw 64, having sharp, clean point as seen in FIG. 4*c*. The screw 64 is completely free from any residual pieces of the endchip maintaining the integrity, strength and surface finish of the flutes 64. In addition, the improved screw can be heat treated or plated with fewer difficulties, keeping manufacturing costs low.

As will be seen from the foregoing, the various advantages and objects set forth in the introduction to this disclosure which provide for the improved die herein have been fully set forth in the foregoing description. Numerous other embodiments, changes, and modifications of this invention will be apparent to those skilled in the art. Thus, the invention is not to be limited to the disclosed embodiments thereof except as defined in the appended claims.

I claim:

1. An improved die for use in manufacturing self-drilling screws having flutes in a pilot end thereof formed by forging a screw blank, said die comprising a generally rectangular block having a cavity for receiving the screw blank; said cavity being shaped to form a point and flute section in the screw blank and causing excess material with a stress from the forging to flow outward from said cavity to form an endchip of uniform thickness and free of cracks and imperfections, which permits the endchip to be removed as a unit; said die having a lower portion forming a bumper and an upper portion forming a shaped face in which said cavity is formed and including a recess formed in said upper portion; said recess comprising an inner arcuate surface being slightly offset from and proximate to said cavity, for receiving a portion of the excess material relieving the stress in the excess material, which strengthens and produces a uniformly planar endchip.

2. An improved die according to claim 1, wherein said recess is elliptically shaped.

3. An improved die according to claim 1, wherein said recess is circular.

4. An improved die according to claim 1, wherein said recess is non-uniform.

5. An improved die according to claim 1, wherein said bumper has a planar face in substantially vertical alignment with said cavity, said face terminating in a top edge proximate to said cavity.

* * * * *